US007640977B2

(12) United States Patent
Jonas

(10) Patent No.: US 7,640,977 B2
(45) Date of Patent: Jan. 5, 2010

(54) SYSTEM AND METHOD FOR CONNECTING MULTIPLE STAGE COMPLETIONS

(75) Inventor: Jason K. Jonas, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 40 days.

(21) Appl. No.: 11/561,546

(22) Filed: Nov. 20, 2006

(65) Prior Publication Data

US 2007/0144746 A1 Jun. 28, 2007

Related U.S. Application Data

(60) Provisional application No. 60/597,402, filed on Nov. 29, 2005.

(51) Int. Cl.
*E21B 17/00* (2006.01)

(52) U.S. Cl. ..... 166/242.6; 166/380

(58) Field of Classification Search ..... 166/380, 166/115, 242.6

See application file for complete search history.

(56) References Cited

U.S. PATENT DOCUMENTS

| | | | | |
|---|---|---|---|---|
| 3,545,542 | A * | 12/1970 | Scott | 166/155 |
| 4,673,242 | A * | 6/1987 | Logan et al. | 385/84 |
| 5,831,156 | A * | 11/1998 | Mullins | 73/152.18 |
| 5,838,857 | A | 11/1998 | Nickrasz | |
| 6,186,229 | B1 | 2/2001 | Martin et al. | |
| 6,378,610 | B2 | 4/2002 | Rayssiguier et al. | |
| 6,390,193 | B1 | 5/2002 | Martin et al. | |
| 6,487,893 | B2 | 12/2002 | Jackson et al. | |
| 6,668,921 | B2 * | 12/2003 | Koehler et al. | 166/242.2 |
| 6,755,253 | B2 | 6/2004 | Smith et al. | |
| 6,789,621 | B2 | 9/2004 | Wetzel et al. | |
| 6,983,796 | B2 | 1/2006 | Bayne et al. | |
| 7,252,437 | B2 * | 8/2007 | Ringgenberg | 385/53 |
| 7,487,830 | B2 * | 2/2009 | Wolters et al. | 166/242.6 |
| 2002/0162666 | A1 | 11/2002 | Koehler et al. | |
| 2003/0173077 | A1 * | 9/2003 | Smith et al. | 166/242.6 |
| 2003/0211768 | A1 * | 11/2003 | Cameron et al. | 439/191 |
| 2005/0072564 | A1 * | 4/2005 | Grigsby et al. | 166/65.1 |
| 2006/0086508 | A1 | 4/2006 | Coon et al. | |

FOREIGN PATENT DOCUMENTS

| | | | |
|---|---|---|---|
| GB | 2333786 | A | 8/1999 |
| GB | 2398806 | A | 9/2004 |
| GB | 2407649 | A | 5/2005 |
| GB | 2410263 | A | 7/2005 |
| GB | 2413399 | A | 10/2005 |
| WO | 0206625 | A1 | 1/2002 |
| WO | 2005045185 | A1 | 5/2005 |

OTHER PUBLICATIONS http://dictionary.reference.com/browse/seal.*
http://dictionary.reference.com/browse/couple.*

* cited by examiner

*Primary Examiner*—Jennifer H Gay
*Assistant Examiner*—Sean D Andrish
(74) *Attorney, Agent, or Firm*—Van Soineren, PC; Daryl R. Wright; James L. Kurka

(57) ABSTRACT

A technique is provided to facilitate connection of multiple stage completions. A first completion stage is deployed at a wellbore location. Subsequently, the next completion stage is moved downhole into engagement with the first completion stage. The completion stages each have communication lines that are coupled together downhole via movement of the completion stages into engagement.

28 Claims, 7 Drawing Sheets

SYSTEM AND METHOD FOR CONNECTING MULTIPLE STAGE COMPLETIONS

CROSS-REFERENCE TO RELATED APPLICATION

The present document is based on and claims priority to U.S. provisional application Ser. No. 60/597,402, filed Nov. 29, 2005.

BACKGROUND

Many types of wells, e.g. oil and gas wells, are completed in multiple stages. A lower stage of the completion is moved downhole on a running string and may comprise either a stand-alone screen or a screen with a gravel pack in the annulus between the screen and the open hole or casing. After the lower completion running string is retrieved, an upper stage of the completion is deployed.

In many applications, it is desirable to instrument the lower completion with electrical or optical sensors or to provide for transmission of fluids to devices in the lower completion. For example, a fiber optic cable can be placed in the annulus between the screen and the open or cased hole. To enable communication of signals between the sensor in the lower completion and the surface or seabed, a wet-mate connection is needed between the upper and lower completion equipment.

Optical, electrical and fluid wet-mate connectors typically are designed as discrete stand-alone components. The stand-alone connectors are mated in a downhole environment that can be full of debris and contaminants. For instance, the mating can take place after an open hole gravel pack which creates a high probability for substantial amounts of debris and contaminants in the wellbore at the vicinity of the connectors during the mating sequence. Existing discrete optical, electrical and fluid wet-mate connectors have proven to be very susceptible to contamination by debris during the mating process.

Furthermore, the discrete nature of the connectors results in an unfavorable geometry that can be difficult to integrate into the completion equipment. The outer diameter of the completion equipment must fit within the inner casing diameter. A centralized, large diameter inner port also is needed to provide access for service equipment into the lower completion and to provide a large flow area for production or injection of fluids. The remaining annular space is not well suited to the typical circular cross section of discrete connectors. This limitation compromises the overall design of the completion equipment and also limits the total number of channels that can be accommodated within a given envelope.

The geometry of the discrete connectors also increases the difficulty of adequate flushing and debris removal from within and around the connectors prior to and during the mating sequence. Attempts to protect the connectors from debris and/or to provide adequate flushing have lead to completion equipment designs that have great complexity with an undesirable number of failure modes.

SUMMARY

In general, the present invention provides a system and method for coupling control line connectors during engagement of multiple stage completions. A first completion stage has a communication line protected from debris and other contaminants. Similarly, a subsequent completion stage has a communication line protected from debris and other contaminants. Following deployment of the first completion stage to a downhole location, the subsequent completion stage is moved into engagement with the first completion stage. During the engagement process, the communication lines are coupled.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
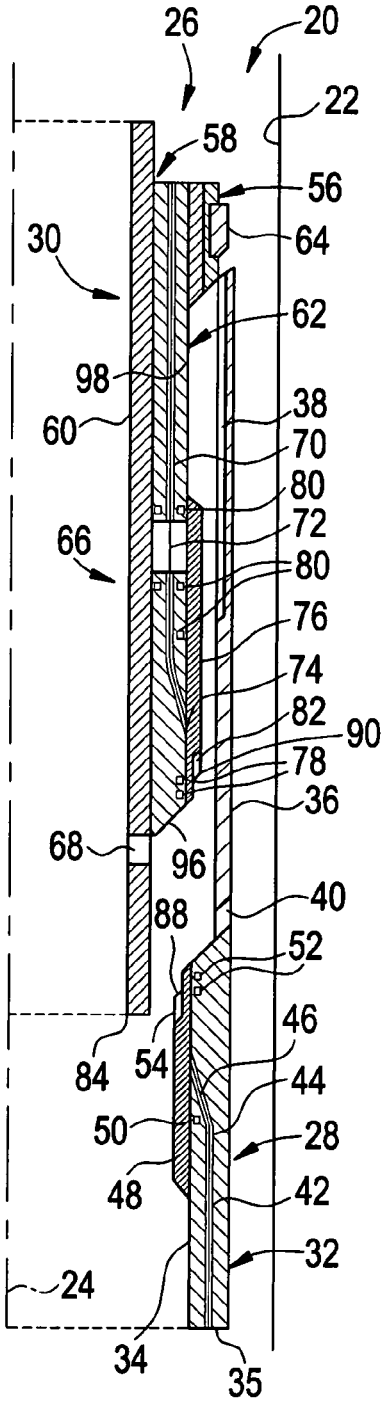
FIG. 1 is a schematic view of a wellbore with a multiple stage completion having completion stages being moved into engagement, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for connecting multiple stage completions in a wellbore environment. The system and methodology enable protection of communication line connectors during deployment and engagement of completion stages. The communication line connectors associated with each completion stage are enclosed for protection from debris and other contaminants that can occur during certain wellbore procedures, e.g. gravel packing procedures. Protecting the communication line connectors facilitates coupling of the connectors upon the engagement of the separate stages at a downhole location. Additionally, the design of the stages and communication line connectors provides a desirable geometry that does not interfere with or limit operation of the completion equipment.

For example, the system enables the deployment of a lower assembly in a wellbore and the subsequent engagement of an upper assembly and one or more control lines. In one embodiment, the system is capable of deploying and connecting a fixed fiber optic sensor network in a two-stage completion. In this embodiment, once the connection is established, a continuous optical path is established from a surface location to the bottom of an open hole formation and back to the surface location to complete an optical loop. The connection also may be established for other control lines, such as electrical control lines or fluid control lines in various combinations. The control line connections may be established, broken and reestablished repeatedly. This type of system may be used for land applications, offshore platform applications, or subsea deployments in a variety of environments and with a variety of downhole components. By way of example, the system may utilize fiber sensing systems and the deployment of fiber optic sensors in sand control components, perforating components, formation fracturing components, flow control components, or other components used in various well operations including well drilling operations, completion operations, maintenance operations, and/or production operations. The system also may be used to connect fiber-optic lines, electric lines and/or fluid communication lines below an electric submersible pump to control flow control valves or other devices while allowing the electric submersible pump to be removed from the wellbore and replaced.

In other embodiments, the system may comprise a well operations system for installation in a well in two or more stages. The well operations system may comprise a lower assembly, an upper assembly, and a connector for connecting a control line in the upper assembly to a corresponding control line in the lower assembly. This type of connection system and methodology can be used to connect a variety of downhole control lines, including communication lines, power lines, electrical lines, fiber optic lines, hydraulic conduits, fluid communication lines, and other control lines. Additionally, the upper and lower assemblies may comprise a variety of components and assemblies for multistage well operations, including completion assemblies, drilling assemblies, well testing assemblies, well intervention assemblies, production assemblies and other assemblies used in various well operations. The upper and lower assemblies also may comprise a variety of components depending on the application, including tubing, casing, liner hangers, formation isolation valves, safety valves, other well flow/control valves, perforating and other formation fracturing tools, well sealing elements, e.g. packers, polish bore receptacles, sand control components, e.g. sand screens and gravel packing tools, artificial lift mechanisms, e.g. electric submersible pumps or other pumps/gas lift valves and related accessories, drilling tools, bottom hole assemblies, diverter tools, running tools and other downhole components.

It also should be noted that within this description, the term "lower" also can refer to the first or lead equipment/assembly moved downhole. Furthermore, the term "upper" can refer to the second or later equipment/assembly moved downhole into engagement with the lower unit. In a horizontal wellbore, for example, the lower equipment/assembly is run downhole first prior to the upper equipment/assembly.

Referring generally to FIG. 1, a portion of a wellbore 20 is illustrated between a wellbore wall 22 and a wellbore centerline 24. A completion 26 is illustrated in cross-sectional profile as having a first or lower completion stage 28 and a second or upper completion stage 30. The lower completion stage generally is the stage deployed first into either a vertical or deviated wellbore. Also, the lower completion stage 28 and the upper completion stage 30 may comprise a variety of completion types depending on the specific wellbore application for which the multiple stage completion is designed. For example, the lower stage completion may be designed with sand screens or screens with gravel pack components. In FIG. 1, the lower completion stage 28 has been moved to a desired downhole location with a service tool or with other deployment or running equipment, as known to those of ordinary skill in the art. Once lower completion stage 28 is positioned in the wellbore and the deployment equipment is retrieved, the next completion stage 30 can be moved downhole toward engagement with the lower completion stage, as illustrated, to ultimately form a connection.

The lower completion stage 28 comprises a housing 32 that forms a receptacle 34 which is run into the wellbore and remains in the wellbore with lower completion stage 28 when the service tool is removed. Housing 32 comprises a lower body section 35 and a shroud 36, e.g. a helical shroud or muleshoe, having an alignment slot 38 and a flush port 40. Lower completion stage 28 also comprises a passageway 42 through housing 32 for routing of a communication line 44 to a communication line connector 46 integrated with the lower completion stage. Communication line 44 may comprise, for example, a fiber optic line, an electric line, an auxiliary conduit or control line for transmitting hydraulic or other fluids, or a tubing for receiving a fiber optic line. Correspondingly, communication line connector 46 may comprise a fiber optic connector, an electric line connector, a hydraulic connector, or a tubing connector through which a fiber optic line is deployed. By way of specific example, communication line connector 46 comprises a fiber optic ferrule receptacle; communication line 44 comprises an optical fiber disposed within a flexible protected tube; and passageway 42 comprises an optical fluid chamber. The optical fluid chamber can be compensated to equal or near hydrostatic pressure in the wellbore, or the chamber can be at atmospheric pressure or another pressure.

In this embodiment, the lower completion stage 28 further comprises a displaceable member 48 movably disposed along a surface of receptacle 34 to enclose communication line connector 46. Enclosing communication line connector 46 protects the connector from wellbore debris and other contaminants prior to completing engagement of upper completion stage 30 with the lower completion stage. In the embodiment illustrated, displaceable member 48 is a sleeve, such as a spring loaded sleeve biased toward a position enclosing communication line connector 46. Displaceable member, e.g. sleeve, 48 may be sealed to housing 32 via at least one lower seal 50 and at least one upper seal 52. As illustrated, sleeve 48 also may comprise one or more debris exclusion slots 54.

The upper completion stage 30 comprises an upper completion housing 56 that forms a stinger 58 designed for insertion into and engagement with receptacle 34. Housing 56 may comprise an inner tubing 60, a surrounding upper body portion 62, and an alignment key 64. The inner tubing 60 has any interior 66 for conducting fluid flow and one or more radial flush ports 68 through which a flushing fluid can be conducted from interior 66 to the exterior of stinger 58. The surrounding upper body portion 62 may comprise a passageway 70 for routing of a communication line 72 to a communication line connector 74 integrated with the upper completion stage. As with lower completion stage 28, the communication line may comprise, for example, a fiber optic line, an electric line, an auxiliary conduit or control line for transmitting hydraulic or other fluids, or a tubing for receiving a fiber optic line. Correspondingly, communication line connector 74 may comprise a fiber optic connector, an electric line connector, a hydraulic connector, or a tubing connector through which a fiber optic line is deployed. By way of specific example, communication line connector 74 comprises a fiber optic ferrule plug or receptacle; communication line 72 comprises an optical fiber disposed within a flexible, protected tube that is extensible; and passageway 70 comprises an optical fluid chamber. The optical fluid chamber can be compensated to equal or near hydrostatic pressure in the wellbore, or the chamber can be at atmospheric pressure or another pressure.

The upper completion stage 30 further comprises an upper completion displaceable member 76 movably disposed along an outer surface of housing 56 to enclose communication line connector 74. Enclosing communication line connector 74 protects the connector from wellbore debris and other contaminants prior to completing engagement of upper completion stage 30 with the lower completion stage 28. Similar to displaceable member 48, upper completion displaceable member 76 may be formed as a movable sleeve, such as a spring loaded sleeve biased toward a position enclosing communication line connector 74. Displaceable member, e.g. sleeve, 76 may be sealed to housing 56 via at least one lower seal 78 and at least one upper seal 80. As illustrated, sleeve 76 also may comprise one or more debris exclusion slots 82.

Figure 2:
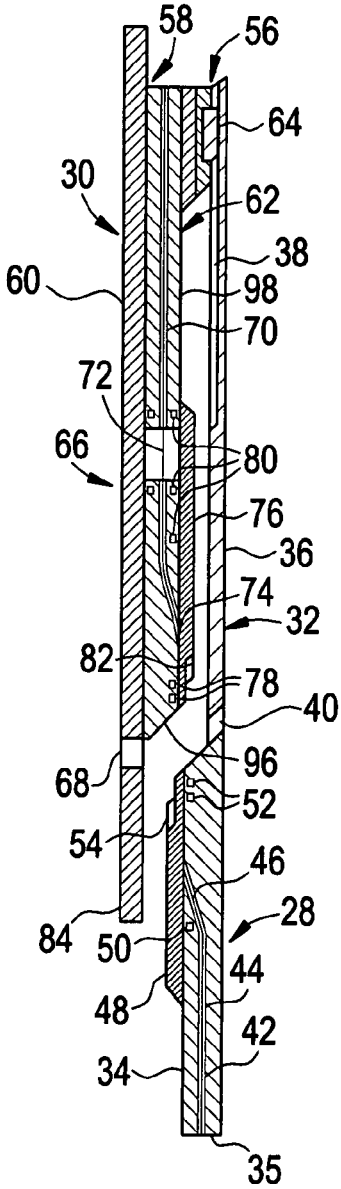
FIG. 2 is a schematic view similar to that of FIG. 1 but showing the first and second completion stages during a different period of the engagement process, according to an embodiment of the present invention.

As stinger 58 is moved into receptacle 34, alignment key 64 engages alignment slot 38, as illustrated best in FIG. 2. As the stinger continues to move into receptacle 34, alignment key 64 and alignment slot 38 cooperate to orient the upper completion stage 30 with respect to the lower completion stage 28 such that the lower communication line connector 46 and upper communication line connector 74 are properly aligned when the upper and lower completion stages are fully landed, i.e. engaged.

Figure 3:
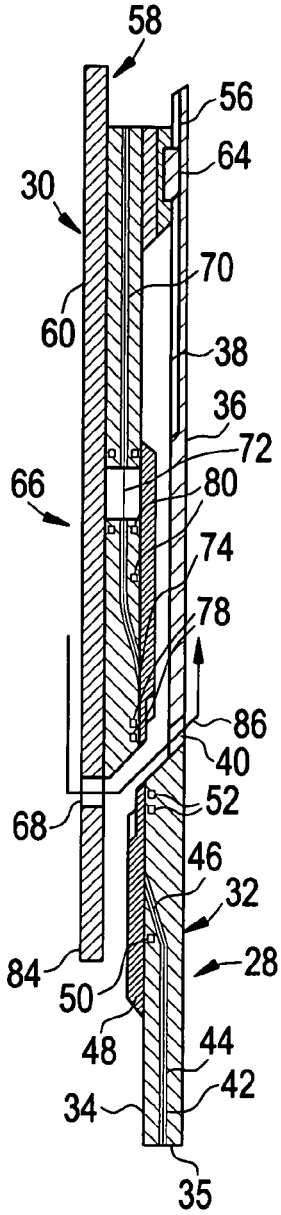
FIG. 3 is a schematic view similar to that of FIG. 1 but showing the first and second completion stages during another period of the engagement process, according to an embodiment of the present invention.

While the upper completion stage 30 is lowered into the wellbore and into engagement with lower completion stage 28, a flushing fluid is circulated continuously from the interior 66 of tubing 60 through a bottom opening 84 of tubing 60 and through radial flush ports 68. From radial flush ports 68, the fluid can circulate outwardly through flush ports 40 of lower completion stage 28 along a flushing flow path 86, as best illustrated in FIG. 3. The fluid velocity and flushing effectiveness increases as the gap narrows between upper completion stage 30 and lower completion stage 28. The completion may be designed such that seals on the upper completion stage 30 engage the lower completion stage 28 in a manner that blocks further flow through bottom opening 84. This forces all of the flushing fluid flow through radial flush ports 68 and 40 to further increase the flushing effectiveness in the vicinity of communication line connectors 46 and 74.

Figure 4:
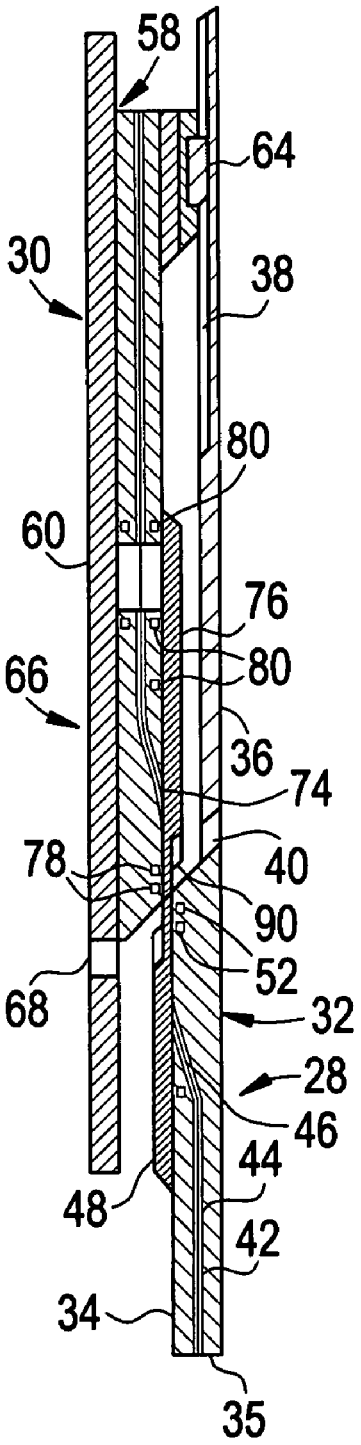
FIG. 4 is a schematic view similar to that of FIG. 1 but showing the first and second completion stages during another period of the engagement process, according to an embodiment of the present invention.
Figure 5:
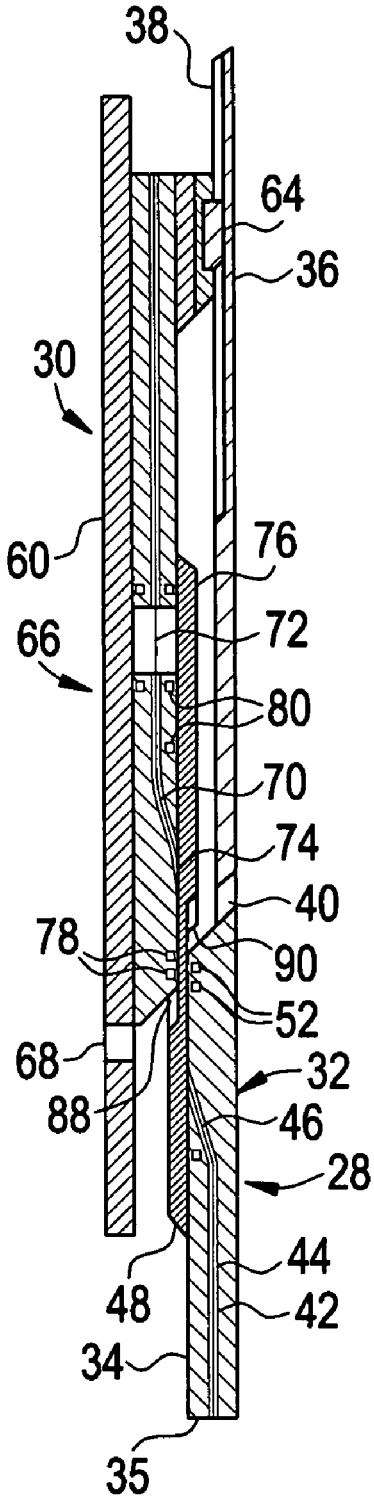
FIG. 5 is a schematic view similar to that of FIG. 1 but showing the first and second completion stages during another period of the engagement process, according to an embodiment of the present invention.

As the upper completion stage 30 is continually lowered, the upper sleeve 76 contacts the lower sleeve 48, as illustrated best in FIG. 4. The contact between sleeve 76 and sleeve 48 blocks further flow of flushing fluid from port 68 to port 40. The upper completion stage 30 is then allowed to move further into lower completion stage 28. This movement causes the upper sleeve 76 to retract and seals 78 to engage and move along the lower sleeve 48 until the upper body portion 62 reaches a mechanical stop 88, as illustrated best in FIG. 5.

Figure 6:
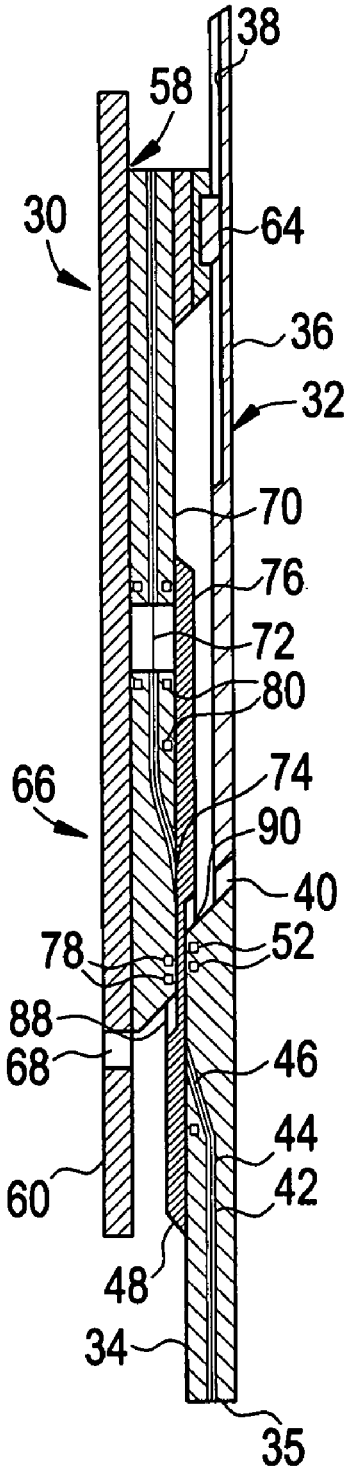
FIG. 6 is a schematic view similar to that of FIG. 1 but showing the first and second completion stages during another period of the engagement process, according to an embodiment of the present invention.

Further movement of the upper completion stage 30 causes the lower sleeve 48 to retract, as illustrated best in FIG. 6. It should be noted that in the embodiment illustrated, displaceable members 48 and 76 are being described as spring biased sleeves that are biased in a direction toward enclosing the communication line connector ends in a sealed environment. The retraction of lower sleeve 48 enables the upper sleeve 76 to continually move downward, creating a seal against lower body 35 in receptacle 34, until a mechanical stop 90 is reached. At this point, the upper completion stage 30 has become sealingly engaged with the lower completion stage 28.

The mechanical stops 88 and 90 determine the relative locations between upper body portion 62 and lower sleeve 48 and between upper sleeve 76 and lower body portion 35. Those relative locations remain fixed throughout the remainder of the landing/engagement sequence. Relative spring rates on spring biased sleeves 48, 76 can be used to control the opening sequence by determining which of the two sleeves retracts first.

Figure 7:
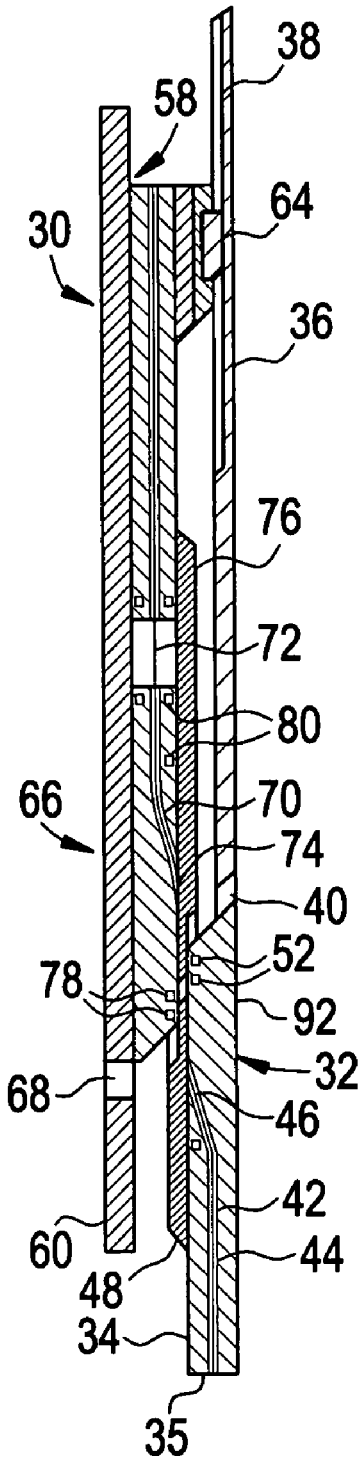
FIG. 7 is a schematic view similar to that of FIG. 1 but showing the first and second completion stages during another period of the engagement process, according to an embodiment of the present invention.
Figure 8:
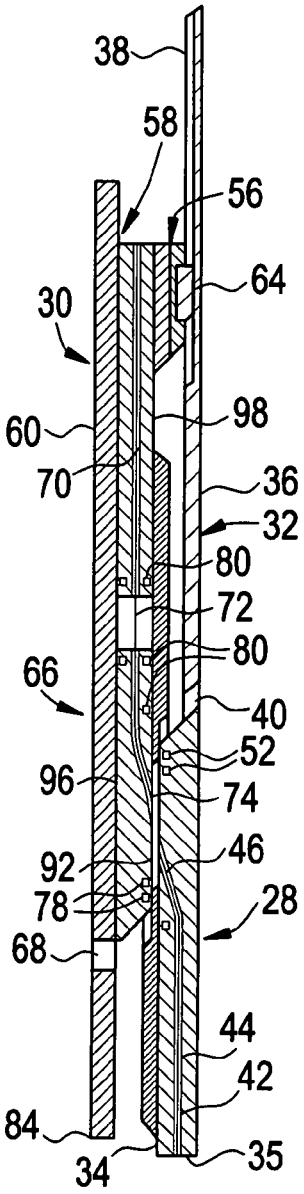
FIG. 8 is a schematic view similar to that of FIG. 1 but showing the first and second completion stages during another period of the engagement process, according to an embodiment of the present invention.

As the insertion of upper completion stage 30 into lower completion stage 28 continues, lower sleeve 48 and upper sleeve 76 continue to retract, as illustrated best in FIG. 7. The continued retraction of the lower and upper sleeve creates a communication line connection chamber 92 that is sealed between upper body portion 62, lower body portion 35, upper sleeve 76 and lower sleeve 48. Continued insertion of upper completion stage 30 into lower completion stage 28 expands the size of chamber 92 until communication line connectors 46 and 74 are exposed to communication line connector chamber 92, as illustrated best in FIG. 8.

Figure 9:
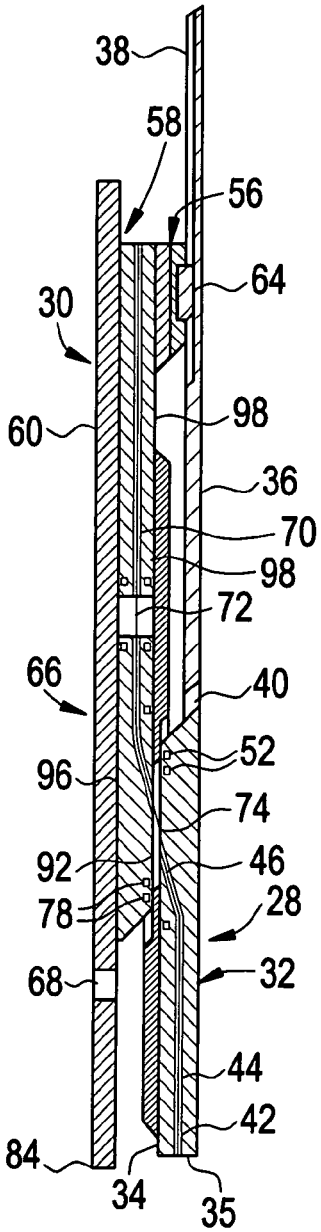
FIG. 9 is a schematic view similar to that of FIG. 1 but showing the first and second completion stages during another period of the engagement process, according to an embodiment of the present invention.
Figure 10:
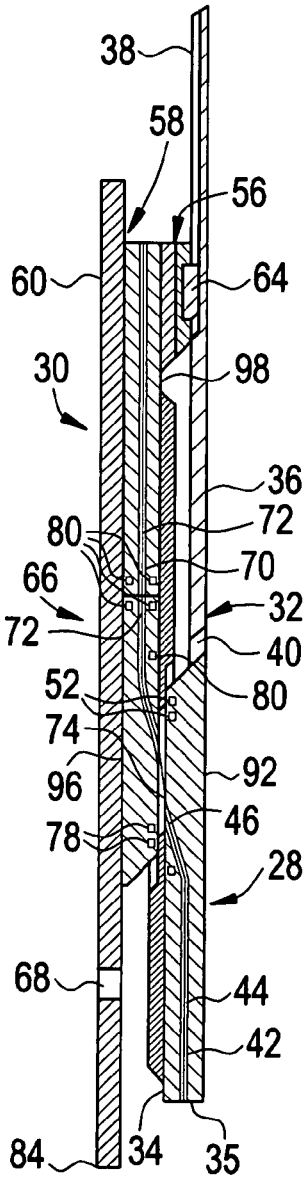
FIG. 10 is a schematic view illustrating full engagement of the first and second completion stages, according to an embodiment of the present invention.

One or both of the communication line connectors can be moved into chamber 92 for coupling with the other connector. In the embodiment illustrated, however, communication line connector 74 is moved into and through chamber 92. In this embodiment, upper body portion 62 is formed as a telescoping body having a first component 96 and a second component 98 that can be moved together to force communication line 72 through passageway 70 of first component 96. The movement of communication line 72 pushes communication line connector 74 into chamber 92, as illustrated best in FIG. 9. Ultimately, the telescoping movement of upper body portion 62 pushes connector 74 into full engagement with connector 46, e.g. into full engagement of a ferrule plug with a ferrule receptacle. The coupling of connectors is accomplished without exposing either of the communication line connectors to detrimental debris or contaminants from the surrounding environment. Also, a telescoping spring (not shown) can be used to hold telescoping body 62 in an open position to ensure that sleeves 48 and 76 are retracted and chamber 92 is fully opened before the telescoping process begins. Relative spring rates between the telescoping spring and the spring biased sleeves can be used to control this mating sequence.

Telescoping body 62 can be designed in a variety of configurations. For example, the telescoping body 62 can be attached to upper completion stage 30 such that allowing the upper completion stage to move further downhole automatically compresses a telescoping spring and cause movement of second component 98 toward first component 96. In another configuration, a piston chamber can be ported to the interior of tubing 60 on one side and to annulus pressure on the other side. A piston within the piston chamber can be used to compress a telescoping spring by increasing tubing pressure above annulus pressure. In another configuration, the piston chamber can be ported to a control line extending to the surface instead of to the interior of tubing 60. Pressure within the control line can be increased above annulus pressure to compress the telescoping spring. Alternatively, both sides of the piston chamber can be ported to control lines run to a surface location. Increasing control line pressure in one control line and taking returns with the other control line can be used to again compress the telescoping spring and move second component 98 toward first component 96. These and other configurations can be used to move one or both of the control line connectors into and through chamber 92 in forming a control line coupling.

The geometry of lower completion stage 28 and upper completion stage 30 enables efficient and thorough flushing and cleaning of the area around and between the communication line connection components prior to initiating the mating of the two completion stages. Additionally, the communication line connectors and communication lines are fully sealed from wellbore fluids during running of the lower completion stage and the upper completion stage in hole, during the mating sequence, and after the wet-mate connection has been established. The seals used, e.g. seals 52 and 78, can be high-pressure seals that are durable in downhole applications. The sleeve members 48 and 76 and other members forming chamber 92 can be correspondingly sized to withstand high pressures, e.g. the maximum hydrostatic pressure plus injection pressure expected in the wellbore, while the sealed chamber remains at atmospheric pressure.

Figure 11:
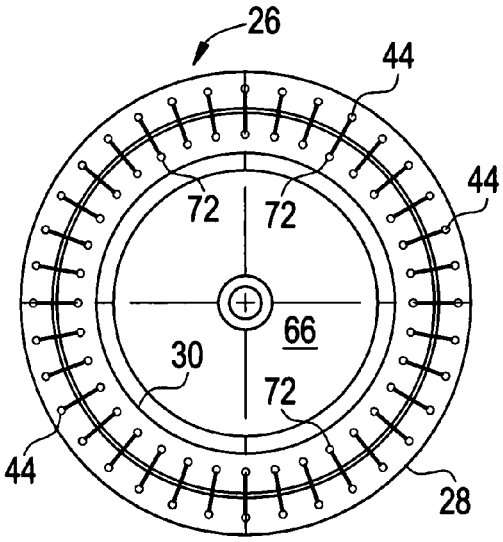
FIG. 11 is a cross-sectional view of an alternate embodiment of a multiple stage completion, according to another embodiment of the present invention.

Referring generally to FIG. 11, an alternate embodiment of the connection assembly is illustrated. The cross-sectional view of FIG. 11 is taken at to different levels to show a plurality of integrated lower stage communication lines 44, e.g. control lines, coupled with a plurality of upper completion stage communication lines 72, e.g. control lines. This approach accommodates multiple communication channels along the completion. In the embodiment illustrated, the plurality of communication channels formed by corresponding communication lines 44, 72 are spaced circumferentially around completion 26, although the communication channels can be located or spaced differently depending on the application.

Figure 12:
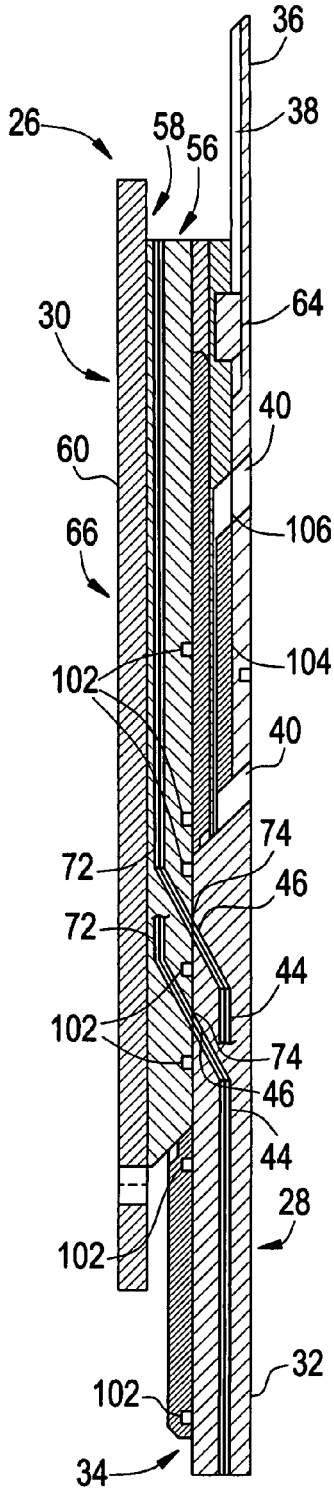
FIG. 12 is a schematic view of another embodiment of a multiple stage completion having completion stages moved into engagement, according to an alternate embodiment of the present invention.
Figure 13:
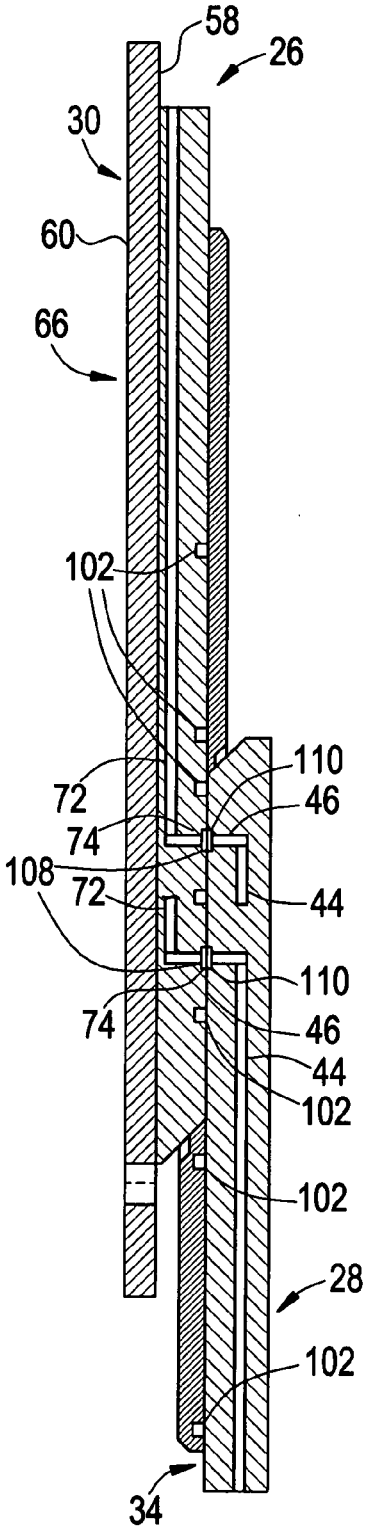
FIG. 13 is a schematic view of another embodiment of a multiple stage completion having completion stages moved into engagement, according to an alternate embodiment of the present invention.
Figure 14:
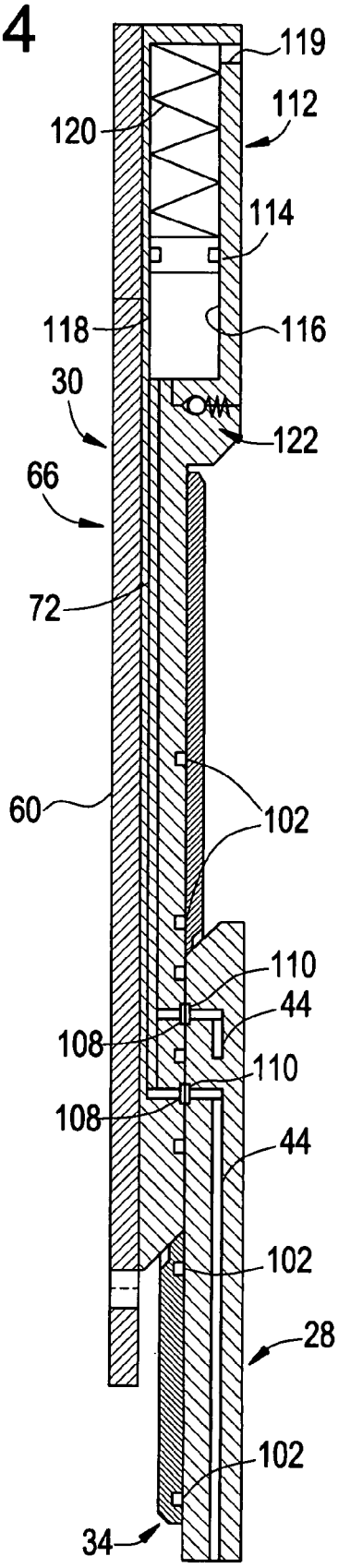
FIG. 14 is a schematic view of another embodiment of a multiple stage completion having completion stages moved into engagement, according to an alternate embodiment of the present invention.

Referring generally to FIGS. 12-14, additional alternate embodiments of the connection assembly are illustrated. In these embodiments, the communication line connectors also are integrated into the completion stages and thereby protected from debris and other contaminants to improve the connections formed. The connections may be formed by bringing the appropriate components, e.g. ferrules, contacts or ports, into alignment with each other axially and radially. The connection does not require lateral travel of the ferrules or other components. To form such a connection, each of the communication lines, e.g. hydraulic ports, is sealed individually and isolated from each other in addition to the circumferential sleeve seals used to isolate ports from the wellbore.

In FIG. 12, one alternate configuration is illustrated that is suitable for hydraulic connections but can also be used for optical or electrical connections. In this embodiment, a plurality of communication lines 44, e.g. hydraulic ports, is provided and the ports are disposed sequentially in an axial direction along lower completion stage 28. The communication lines 44 are integrated with the lower completion stage and are coupled with communication line connectors 46. Similarly, a plurality of communication lines 72, e.g. hydraulic ports, is provided and the ports are located sequentially in an axial direction along upper completion stage 30. The communication lines 72 are integrated with the upper completion stage and comprise communication line connectors 74 that engage connectors 46. The sequential ports are hydraulically isolated by circumferential sleeve seals 102. Generally, the communication lines/ports are not located in the same axial plane but are spaced from each other. Once the connection is made and each set of integrated ports is aligned, optical fiber can be pumped through the connection system in applications utilizing optical fibers. Additionally, this embodiment as well as other illustrated embodiments can utilize a combination alignment system in which key 64 and alignment groove 38 provide for coarse alignment. However, a separate fine alignment key 104 and corresponding fine alignment slot 106 can be used to provide fine alignment of the lower and upper completion stages.

Another alternate embodiment is illustrated in FIG. 13. In this embodiment, the connection system has integrated control line connectors 46/74 that do not require rotational alignment. The communication line connections are accomplished by features that extend around the circumference of stinger 58 and receptacle 34. For example, the communication lines 72 are coupled to circumferential features 108 that engage with corresponding circumferential features 110 coupled to communication lines 44. Because the features are circumferential, the rotational position of the upper completion stage can vary relative to the lower completion stage. To form a hydraulic connection, for example, circumferential features 108 and corresponding circumferential features 110 may be formed as grooves on the outside of the stinger body and the inside of the receptacle body, respectively, to create flow paths for fluids. To form other types of connections, such as electrical connections, the circumferential features can comprise conductors or other suitable elements extending circumferentially to enable the communication of appropriate signals.

In another embodiment, the connection assembly comprises a compensation system 112, as illustrated in FIG. 14. Compensation system 112 can be used to prevent wellbore fluids from being transmitted to the internal components and connectors in the overall system while still allowing the internal components and connectors to be referenced to hydrostatic pressure. This approach reduces the pressure differential to which the seals are subjected without exposing the components and connectors to debris or other corrosive or harmful effects of the wellbore fluids. The compensation system comprises a compensator piston 114 that is sealed within and moves within a chamber 116, e.g. a bore. On one side of compensator piston 114, chamber 116 contains uncontaminated fluid 118 in fluid communication with, for example, fluid communication lines 72. On the other side of piston 114, chamber 116 is referenced to the surrounding wellbore by an external port 119 that extends either to the annulus or the tubing. Optionally, a spring 120 can be used on either side of compensator piston 114 to keep fluid 118 at a pressure significantly or slightly above or below the hydrostatic pressure in the wellbore. The compensator piston 114 moves back and forth in chamber 116 to accommodate changes in wellbore pressure as well as the expansion and compression of internal fluids due to temperature changes. A relief valve 122 also can be utilized to limit the maximum pressure differential. In the embodiment illustrated, a single compensation system 112 is located in a running tool and connected to a plurality of hydraulic ports or passageways to equalize pressure acting on the communication lines in receptacle 34 and the lower completion assembly during installation. Alternatively, separate compensation systems 112 can be connected to individual communication line passageways. Additional flexibility can be added by providing single or multiple lines connected from the running tool to the surface to allow pressure inside the lines/passageways to be actively controlled either collectively or individually from a surface location during installation of receptacle 34. The compensation system can be combined with the various connector assembly embodiments described herein.

Figure 15:
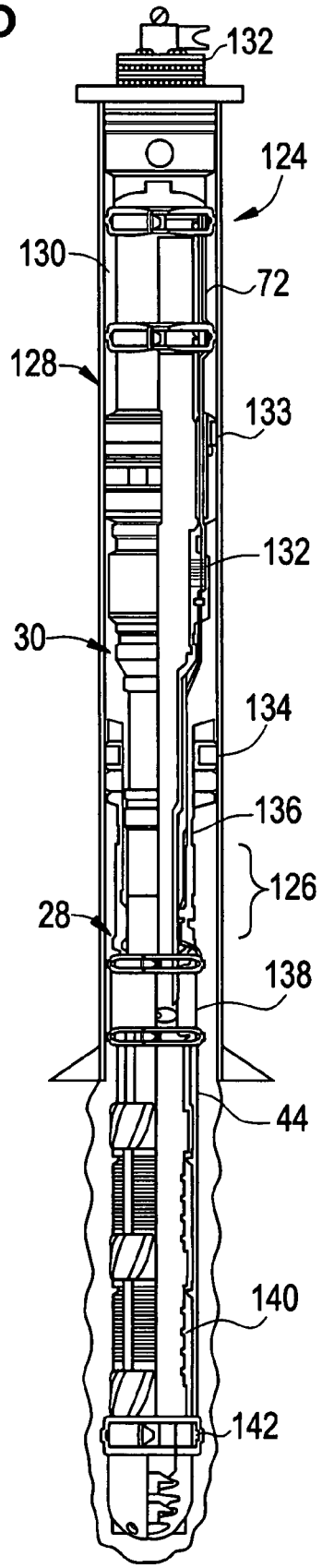
FIG. 15 is an elevation view of one example of a completion system utilizing a multiple stage connection system, according to an embodiment of the present invention.

The various multiple stage connection assemblies described herein can be used with many types of completion systems depending on the specific wellbore application for which a given completion system is designed. In FIG. 15, one example of a completion system 124 utilizing a multiple stage connection assembly 126 is illustrated. It should be noted that the multiple stage connection assembly 126 is representative of the several embodiments described above. Additionally, the completion system 124 is representative of a variety of completion systems, and the components and arrangement of components can vary substantially from one well application to another.

In the embodiment illustrated, completion system 124 comprises a wellbore assembly 128 deployed in a wellbore 130 extending downwardly from a wellhead 132. By way of example, wellbore assembly 128 may comprise an upper completion assembly or stage, e.g. stage 30, having a ported production packer 133 and a contraction joint 132. A communication line, e.g. communication line 72, in the form of a cable, conduit or other suitable communication line extends downwardly to the multiple stage connection assembly. The wellbore assembly 128 also comprises a lower completion assembly or stage, e.g. stage 28, having a variety of components. In one example, the lower completion assembly comprises a gravel pack packer 134, a gravel pack circulation housing 136, a formation isolation valve 138, one or more gravel pack screens 140, and a turnaround loop 142. Additionally, a communication line, e.g. communication line 44, may be in the form of a cable, conduit or other suitable communication line that extends below the multiple stage connection assembly 126.

It should be noted that multiple stage connection assembly 126 can be utilized in many other locations within completion system 124 and with other types of completion systems. For example, the multiple stage connection assembly can be placed above or below gravel pack packer 134. Additionally, the multiple stage connection assembly 126 can be used for connecting many types of communication lines, including fluid lines, electrical lines, optical lines and other types of communication lines. Furthermore, the multiple stage connection assembly can be used to form communication line connections utilized in controlling the operation of flow control components incorporated into completion system 124 or located within wellbore 130 at locations separate from the completion system.

In general, the multiple stage completions have been described in terms of connecting previously installed electric, fiber optic, fluid, or other communication lines. These communication lines or cables can be used for variety of purposes including communication of data. The lines themselves also can be used as sensors or for other purposes. The communication line connectors can be designed for connecting a blank control line in the lower completion stage with a blank control line in the upper completion stage. This control line can then be used to control valves or other devices located in the lower completion. It can also be used to transmit fluids for release into the lower completion in chemical injection or scale inhibitor applications. An optical fiber or other communication line can then be pumped through the coupled blank control line to form a continuous communication line through the multiple stage completion. In other applications, the mating sequence may be adjusted to form the communication line coupling prior to completing the landing of the upper completion stage in the lower completion stage. Other adjustments also can be made to the mating sequence depending on the specific well application. Furthermore, a variety of additional or alternate components can be incorporated into the lower completion stage and/or the upper completion stage to accommodate various well procedures.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A downhole completion system, comprising:

a lower completion stage having a receptacle and a first communication line connector;

an upper completion stage having a stinger and a second communication line connector, wherein the lower completion stage further comprises a first sleeve enclosing the first communication line connector; and the upper completion stage further comprises a second sleeve enclosing the second communication line connector, the first sleeve and the second sleeve being positioned such that sufficient insertion of the stinger into the receptacle moves the first sleeve and the second sleeve to enable coupling of the first and second communication line connectors; and an alignment feature to align the first communication line connector with the second communication line connector upon the sufficient insertion, the sufficient insertion further moving the first sleeve and the second sleeve to create a sealed chamber in which the first and second communication line connectors are coupled.

2. The downhole completion system as recited in claim 1, further comprising fiber optic lines coupled to the first communication line connector and to the second communication line connector.

3. The downhole completion system as recited in claim 1, further comprising tubing lines coupled to the first communication line connector and to the second communication line connector.

4. The downhole completion system as recited in claim 3, wherein the tubing lines are sized to receive a fiber optic line therethrough.

5. The downhole completion system as recited in claim 1, wherein the first sleeve and the second sleeve are spring loaded sleeves.

6. The downhole completion system as recited in claim 1, wherein the sufficient insertion creates a seal between the lower completion stage and the upper completion stage.

7. A downhole completion system, comprising:

a lower completion stage having a receptacle and a first communication line connector;

an upper completion stage having a stinger and a second communication line connector, wherein the lower completion stage further comprises a first sleeve enclosing the first communication line connector; and the upper completion stage further comprises a second sleeve enclosing the second communication line connector, the first sleeve and the second sleeve being positioned such that sufficient insertion of the stinger into the receptacle moves the first sleeve and the second sleeve to enable coupling of the first and second communication line connectors; and wherein the stinger comprises radial circulation ports.

8. The downhole completion system as recited in claim 7, further comprising fiber optic lines coupled to the first communication line connector and to the second communication line connector.

9. The downhole completion system as recited in claim 7, further comprising tubing lines coupled to the first communication line connector and to the second communication line connector.

10. The downhole completion system as recited in claim 9, wherein the tubing lines are sized to receive a fiber optic line therethrough.

11. The downhole completion system as recited in claim 7, wherein the first sleeve and the second sleeve are spring loaded sleeves.

12. The downhole completion as recited in claim 7, wherein the sufficient insertion creates a seal between the lower completion stage and the upper completion stage.

13. A method of connecting a multiple stage completion, comprising:

enclosing a first communication line connector in a first completion stage;

enclosing a second communication line connector in a second completion stage;

exposing the first communication line connector and the second communication line connector to each other in a common chamber created upon engagement of the second completion stage with the first completion stage at a downhole location; and subsequently moving at least one of the first and second communication line connectors into engagement with the other.

14. The method as recited in claim 13, wherein enclosing the first communication line comprises providing a spring loaded sleeve biased toward an enclosed position.

15. The method as recited in claim 13, wherein enclosing the second communication line comprises providing a spring loaded sleeve biased toward an enclosed position.

16. The method as recited in claim 13, wherein exposing comprises utilizing the second completion stage to move a first displaceable member enclosing the first communication line connector, and utilizing the first completion stage to move a second displaceable member enclosing the second communication line connector.

17. The method as recited in claim 13, further comprising connecting fiber optic lines to the first and second communication line connectors.

18. The method as recited in claim 13, further comprising connecting blank tubing lines to the first and second communication line connectors.

19. The method as recited in claim 13, further comprising connecting electric lines to the first and second communication line connectors.

20. A method of forming a completion in a wellbore, comprising:

deploying a lower completion stage downhole;

landing an upper completion stage having a second communication line connector in the lower completion stage having a first communication line connector;

forming a sealed communication line chamber during landing; and exposing the first communication line connector and the second communication line connector to each other in the sealed communication line chamber created upon engagement of the second completion stage with the first completion stage at a downhole location; and subsequently moving the first communication line connector outwardly from a communication line passageway and into engagement with the second communication line connector in the sealed communication line chamber.

21. The method as recited in claim 20, further comprising circulating a flushing fluid through the upper completion stage during landing.

22. The method as recited in claim 20, further comprising enclosing the first and second communication line connectors with slidable sleeves prior to forming the sealed communication line chamber.

23. The method as recited in claim 20, wherein extending comprises connecting a fiber optic line.

24. The method as recited in claim 20, further comprising using an alignment feature to rotationally align the upper completion stage with the lower completion stage during landing.

25. The method as recited in claim 20, wherein landing comprises inserting a stinger into a receptacle.

26. A completion system, comprising:

a lower completion stage having a first line connector enclosed by a first sleeve; and an upper completion stage having a second line connector enclosed by a second sleeve;

the first and second sleeves being movable to expose the first and second line connectors in a common chamber created upon engagement of the upper completion stage with the lower completion stage at a downhole location, wherein at least one of the first and second line connectors is movable outwardly from a communication line passageway following engagement of the upper completion stage with the lower completion stage.

27. The system as recited in claim 26, wherein the first and second sleeves are spring loaded sleeves.

28. The system as recited in claim 26, wherein engagement of the upper completion stage with the lower completion stage moves the first and second sleeves to expose the first and second line connectors.

* * * * *